US007637132B2

(12) United States Patent
Vasta et al.

(10) Patent No.: US 7,637,132 B2
(45) Date of Patent: Dec. 29, 2009

(54) WORK ROLL SCRAPER FOR ROLLER LEVELERS

(75) Inventors: Salvatore James Vasta, Columbiana, OH (US); Anthony Joseph Nackino, Boardman, OH (US)

(73) Assignee: Butech Bliss, Salem, OH (US)

( * ) Notice: Subject to any disclaimer, the term of this patent is extended or adjusted under 35 U.S.C. 154(b) by 160 days.

(21) Appl. No.: 11/541,627

(22) Filed: Sep. 29, 2006

(65) Prior Publication Data

US 2007/0180879 A1 Aug. 9, 2007

Related U.S. Application Data

(60) Provisional application No. 60/766,691, filed on Feb. 6, 2006.

(51) Int. Cl.
*B21C 43/00* (2006.01)
*B21B 28/00* (2006.01)
*B21B 45/02* (2006.01)

(52) U.S. Cl. ..... 72/40; 72/236; 72/160; 15/256.51

(58) Field of Classification Search ..... 72/39, 72/40, 160, 161, 163, 164, 165, 236; 15/256.51
See application file for complete search history.

(56) References Cited

U.S. PATENT DOCUMENTS 1,969,700 A * 8/1934 Taylor ..... 72/160
2,439,889 A 4/1948 Hart et al.
2,962,793 A * 12/1960 Powers et al. ..... 28/245
3,398,022 A 8/1968 Maust et al.
4,454,738 A 6/1984 Buta
4,751,958 A * 6/1988 Flowers et al. ..... 164/473
4,811,586 A 3/1989 Benz et al.
5,255,549 A 10/1993 Williams
5,327,760 A 7/1994 Böhmer et al.
5,392,627 A 2/1995 Benz
5,412,968 A 5/1995 Benz
5,755,131 A 5/1998 Voth
6,029,485 A 2/2000 Böhmer
6,408,668 B1 6/2002 Figge et al.

(Continued)

FOREIGN PATENT DOCUMENTS

JP 11000570 A 1/1999

OTHER PUBLICATIONS

International Search Report for International Application No. PCT/US07/03076.

*Primary Examiner*—Dana Ross
*Assistant Examiner*—Debra M Sullivan
(74) *Attorney, Agent, or Firm*—Fay Sharpe LLP

(57) ABSTRACT

A self-retaining scraping device for continuously cleaning work rolls of a roller leveler assembly has a first wall having two angled or curved portions and a straight portion extending between the angled portions; and a second wall having two angled or curved portions and a straight portion extending between the angled portions.

The first wall and second wall are connected to each other via the straight portions. The angled or curved portions of the first wall extend in an opposite direction from the angled or curved portions of the second wall. The scraping device is inserted between adjacent work rolls and has multiple scraping edges contacting outer surfaces of the work rolls to continuously clean the work rolls. The scraping device is supported by the work rolls.

16 Claims, 9 Drawing Sheets

U.S. PATENT DOCUMENTS 6,612,145 B2 9/2003 Rohleder
6,769,279 B1 8/2004 Bergman et al.
6,782,726 B2 8/2004 Armenat et al.
6,792,783 B1 9/2004 Bergman et al.
6,805,019 B2 * 10/2004 Miyaguchi et al. ..... 74/424
6,848,289 B1 2/2005 Bergman et al.
6,857,301 B1 2/2005 Bergman et al.
6,920,774 B1 7/2005 Bergman et al.

* cited by examiner

WORK ROLL SCRAPER FOR ROLLER LEVELERS

CLAIM OF PRIORITY

This application claims priority from Provisional Application Ser. No. 60/766,691, filed on Feb. 6, 2006, which is incorporated by reference herein.

BACKGROUND OF THE INVENTION

The present invention relates to roller levelers. More particularly, it relates to self-retaining scrapers for continuously cleaning work rolls for roller levelers. Roller levelers are used to flatten metal strip, typically coming from a coil. The strip is unwound and subsequently passed through the roller leveler.

A roller leveler includes multiple pairs of offset work rollers or rolls. Different size levelers can have different quantities of work rolls and back-up rolls. The upper rolls are typically offset one-half the distance between a pair of adjacent lower rolls. The metal strip passes between the upper and lower rolls. The number and spacing of the rolls depend on the thickness and strength of the metal strip. Typically, as the strip thickness decreases, the spacing of the rolls, as well as the roll diameter, decrease. As the strip passes between the rolls, it is bent up and down multiple times before it exits the leveler. This reversed bending beyond the yield point of the material is the mechanism whereby the strip is flattened.

In addition to strip curvature, other unwanted properties are sometimes impressed upon the strip during hot and/or cold rolling which render the problem of flattening strip much more complex. In order to reduce cross-sectional thickness of the strip during rolling, it is necessary to force the strip between rolls under tremendous pressure whereby the strip essentially becomes a wedge which tends to separate the rolls. The force of roll separation is dependent upon the physical properties of the strip including width, thickness, hardness, temperature, yield strength, and amount of reduction being attempted during the pass of the strip between the rolls. If the work rolls are not sufficiently supported by back-up rolls, it is possible for the strip to actually cause the work rolls to bend at their centers, wherein the resultant strip cross-sectional shape is thicker in the middle than at the edges. Strip rolled with thicker center portions indicates that greater pressure has been applied to the edges of the strip than at the center, thereby causing the edges to elongate at a greater rate than the center of the strip. Because this excess metal on the edges must go somewhere, but is restrained by the center, the result usually is a product having what is referred to as edge waves. In other words, the center of the strip is relatively flat longitudinally, but the edges of the strip are sinusoidal.

Just the opposite may occur during rolling of strip, wherein the rolls may be so reinforced, or may be so contoured, that they resist or otherwise offset the wedge effect of the strip. However, if the rolls are over compensated against roll bending, the resultant is strip that is rolled thinner in the center than at the edges. In this circumstance, the center of the strip tends to become elongated, producing a condition sometimes referred to as "oil canning". By this is meant that the elongated center portion of the strip compensates for this elongation by bulging either up or down. The result is strip that can literally be snapped up and down like the bottom of an oil can because of the stresses set up by this localized elongation.

Metal is formed into strip by a process known as rolling, wherein the strip is passed between a pair of work rolls of a rolling mill to reduce its cross-sectional thickness. In the process, the strip is elongated and rolling continues until the strip is reduced to the cross-sectional thickness desired. This rolling process may start with heated billets or slabs of metal, wherein the metal is rolled at a very high temperature, or it may start with previously rolled strip wherein the strip is passed between work rolls in the cold state. In either event, when the strip exits from the mill, it may be convolutedly wrapped to form a coil. When the coil has been formed, curvature of the coil tends to stay with the strip when it is necessary to uncoil the strip for further processing. Thus, the primary problem with strip coming off of a coil is the curvature which remains with the strip and which varies throughout the entire length of the coil as a function of the radius of any particular portion of the strip while in the coil. Accordingly, the outer wrap of the coil will have less curvature than an inner wrap. To remove this variable curvature in the strip is one of the purposes of a roller leveler. It is necessary to remove this curvature so that the strip may be cut accurately and rendered suitable for other manufacturing operations, such as punching, drawing, forming and the like. It is well established that the flatter the strip is prior to a subsequent manufacturing operation, the more accurate and satisfactory will be the end product of that operation. Thus, even where portions of steel strip are deep drawn, they do not draw as satisfactorily if the strip initially is not substantially flat before the draw.

For some materials, the strip is covered with scale and other fine particulates. Additionally, as the strip passes through the leveling section, more fine scale is generated as a result of the reverse bending action. Overtime, the scale or "dirt" like deposits collect on the faces of the work rolls and can ultimately imprint a mark on the strip, thus hurting the surface quality of the strip. It is thus desirable to remove the scale or "dirt" from the strip.

For some metals, the strip can have a surface scale that breaks up as the strip passes between the leveler work rolls. This scale can stick to the surfaces of the work rolls and build up to a point where the scale imprints marks on the surfaces of the strip. Additionally, other "dirt" can enter the leveler and mark the strip.

Several existing techniques are used to minimize or eliminate marking of the strip, including frequent extraction of the work rolls from the leveler with subsequent off-line cleaning. Another method includes cleaning of the work rolls while they are still in the machine but the line is not running. In other words, between processing coils, when the strip has tailed out of the leveler, a cleaning pad can be mechanically inserted into the roll nip, and the roll is turned against this mildly abrasive surface. Yet another method includes washing the work rolls with a water spray when the line is not running.

Each of these techniques has a common problem; that is, they all affect the productivity of the process, as they require the leveler to not be in production during the cleaning cycle. They also may require removal of the work rolls from the leveler. Also, for longer coil runs, there can be sufficient buildup to cause additional strip marking before the coil is even totally processed.

Accordingly, there is a need for a method for continuously cleaning the Work rolls which does not require removing the work rolls or shutting down the leveler, thus improving productivity, which overcomes the above-mentioned deficiencies and others, while obtaining better and more advantageous results.

SUMMARY OF THE INVENTION

The present invention relates to a roller leveler for metal sheet and strip with top and bottom work rollers offset relative to each other and supported by back-up rollers.

More particularly, the present invention relates to a scraper which is used to continuously clean work rolls of a roller leveler. The scrapers are constructed in a manner that allows them to nestle between adjacent work rolls. A key element of the design is the inherent spring centering of the scrapers. In this manner, the scrapers become self-supporting between the rolls, and the centering force overcomes forces that attempt to dislodge the scraper. These forces could occur as a result of a particle stuck to the roll surface. When the particle encounters the scraping blade and until the scraper "plucks" or scrapes it off, the particle causes the scraper to move up or down relative to the work roll surface. When the particle is gone, the re-centering nature of the scraper restores the scraper to its natural position.

In one embodiment, the scraper includes a stiff, "T"-shaped center element that reduces the noise level of the scrapers. Continuous cleaning of the roll surfaces results in very smooth, dry, relatively high friction roll surfaces. This higher friction causes the scraping edges to drag on the roll surface which in turn excites the scraper at its natural frequency, which translates into noise. The T-shaped section increases the stiffness of the assembly and resists the noise generating vibrations. This is accomplished while keeping an "X"-shaped element, which is interposed between adjacent work rolls to clean the rolls, relatively thin and flexible. Thus, the design provides a flexible, lightly loaded scraping element, as well as a stiff spine formed by the "T"-shaped element to attenuate noise.

Another aspect of the present invention is to selectively support the scraper at several strategically placed locations. In one embodiment, the scraper is fixed on its ends to the work roll bearing housings. Also, in several places along its length, a spacer is imposed between the top surface of the "T" element and an adjacent machine surface; in this case, the back-up roll housings. These support points cooperatively prevent the scraper from vibrating beyond an acceptable amplitude from a noise generation standpoint.

The cross-sectional shape of the scraper imparts multiple characteristics, such as spring qualities for the scraping action and self-retention and high backbone stiffness for noise attenuation. The length depends on the length of the work rolls and end mounts, and intermediate supports complete the elements needed to attenuate noise.

Obviously, material thicknesses and scraper geometry will vary dependent on work roll diameter and spacing. An alternate embodiment combines the backbone stiffness and spring qualities into a single, "clip"-type, one-piece cross-section.

For very small work roll diameters and very close centers, the scraper can be machined entirely from a solid material, such that the desired cross-sectional shape is achieved by machining, or mechanical fastening of appropriate individual pieces.

Thus, in accordance with one aspect of the invention, a scraping device for use with work rolls of a roller leveler assembly includes a first wall having two angled portions and a straight portion extending between the angled portions; a second wall having two angled portions and a straight portion extending between the angled portions; the first wall and second wall end are connected to each other via the straight portions; and wherein the angled portions of the first wall extend in an opposite direction from the angled portions of the second wall.

In accordance with another aspect of the invention, a scraping device for continuously cleaning work rolls of a roller leveler has a first, curved wall; and a second, curved wall attached to the first wall, wherein the first wall and the second wall are curved in opposite directions.

In accordance with another aspect of the invention, a roller leveler assembly has a frame; a bank of upper and lower work rolls journalled in the frame; and a bank of upper and lower back-up rolls in contact with the work rolls to support the work rolls. The work rolls perform leveling on a work product passing through a gap formed between upper and lower work rolls. The back-up rolls are mounted within the back-up housing.

A self-retaining scraping device for continuously cleaning the work rolls has a first wall having two angled portions and a straight portion extending between the angled portions; a second wall having two angled portions and a straight portion extending between the angled portions; the first wall and second wall end connected to each other via the straight portion. The angled portions of the first wall extend in an opposite direction from the angled portions of the second wall; wherein the scraping device is supported on the work rolls by the angled walls contacting the work rolls.

In accordance with another aspect of the invention, a method of continuously cleaning work rolls of a roller leveler assembly includes providing a scraper device having a central member and a pair of angled walls on opposite ends of the central member, where the angled walls extend in opposite directions from each other; inserting the scraper device between adjacent work rolls of the roller leveler and slightly flexing the angled walls of the scraper device; and supporting the scraper device on the adjacent work rolls of the roller leveler such that edges of the angled walls contact outer surfaces of the work rolls.

One object of the invention is the provision of self-retention of the scrapers between adjacent work rolls with a profile that provides a surface scraping action on adjacent work roll surfaces. The scrapers retain their position between work rolls regardless of forward or reverse rotation of the work rolls. The scraper devices do not require a tether or other securing means to stay in position on the roller leveler.

Another object of the present invention is that the scraping devices are easily installed by snapping them into place between adjacent work rolls.

Yet another object of the present invention is that the scraping devices maintain a spring force against the entire length of the work rolls.

Still another object of the present invention is that the scraping devices provide multiple scraping edges for a work roll.

Another object of the invention is the provision of using several shorter segments of scrapers over the length of the work roll face versus a continuous length.

Still yet another object of the invention is to provide a way of continuously cleaning the surface of the work rolls to inhibit the buildup of scale or "dirt". The present invention overcomes the productivity shortcoming by providing a continuous cleaning technique while the leveler is processing strip. In other words, there is no lost production time required during the cleaning of the rolls. Continuous cleaning also has the advantage of keeping the roll surfaces clean regardless of the length of coil run and regardless of the rate of "dirt" generation.

Other objects, features and advantages of the invention will become apparent to those skilled in the art from a study of the detailed descriptions of the preferred embodiments set forth herein and illustrated in the accompanying drawings.

BRIEF DESCRIPTION OF THE DRAWINGS

Further aspects of the invention will become apparent by reference to the detailed description when considered in conjunction with the Figures, wherein like reference numbers indicate like elements through the several views, and wherein.

DETAILED DESCRIPTION OF THE EMBODIMENTS

Figure 1:
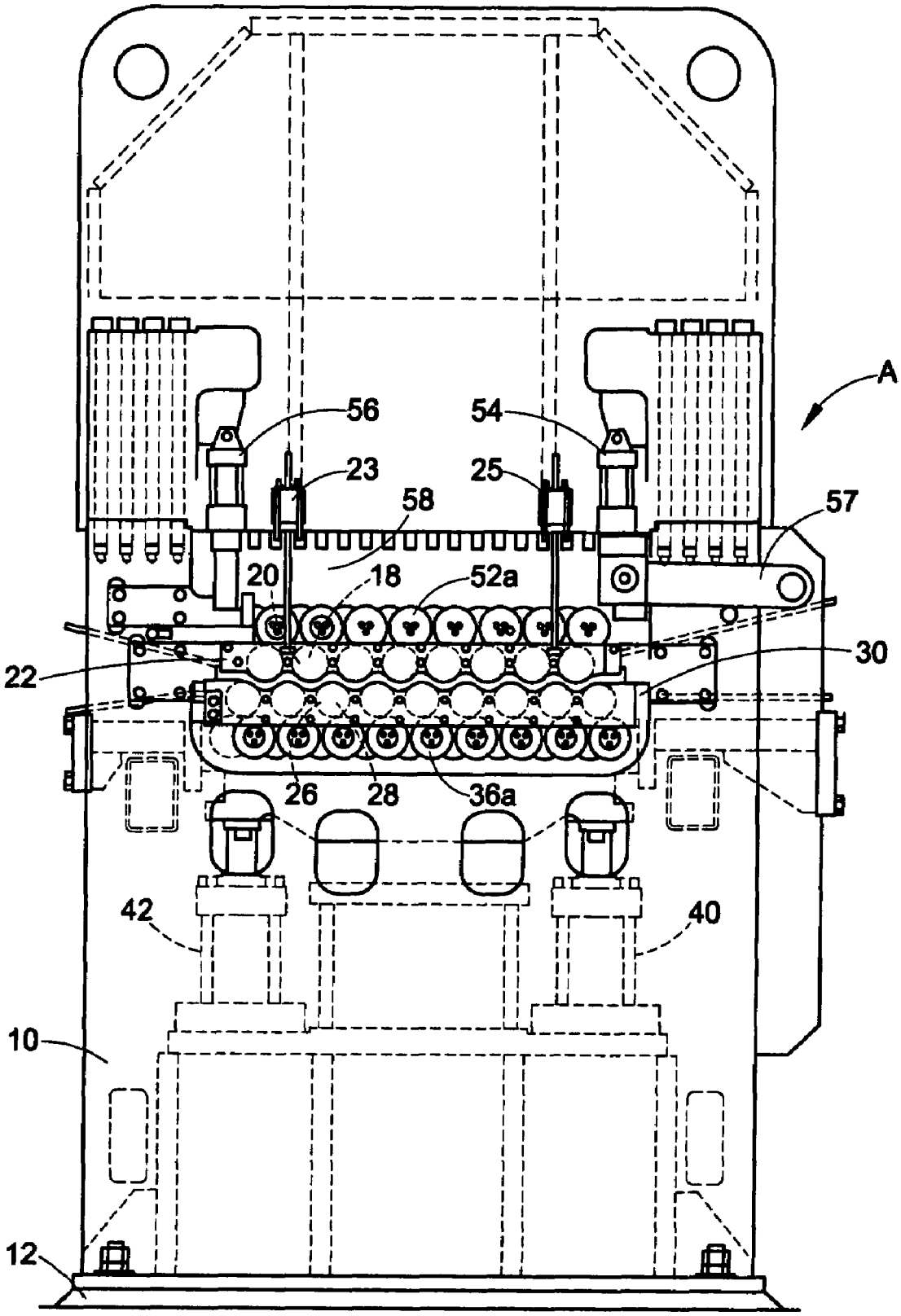
FIG. 1 is a side elevational view of a roller leveler in accordance with one aspect of the invention.
Figure 2:
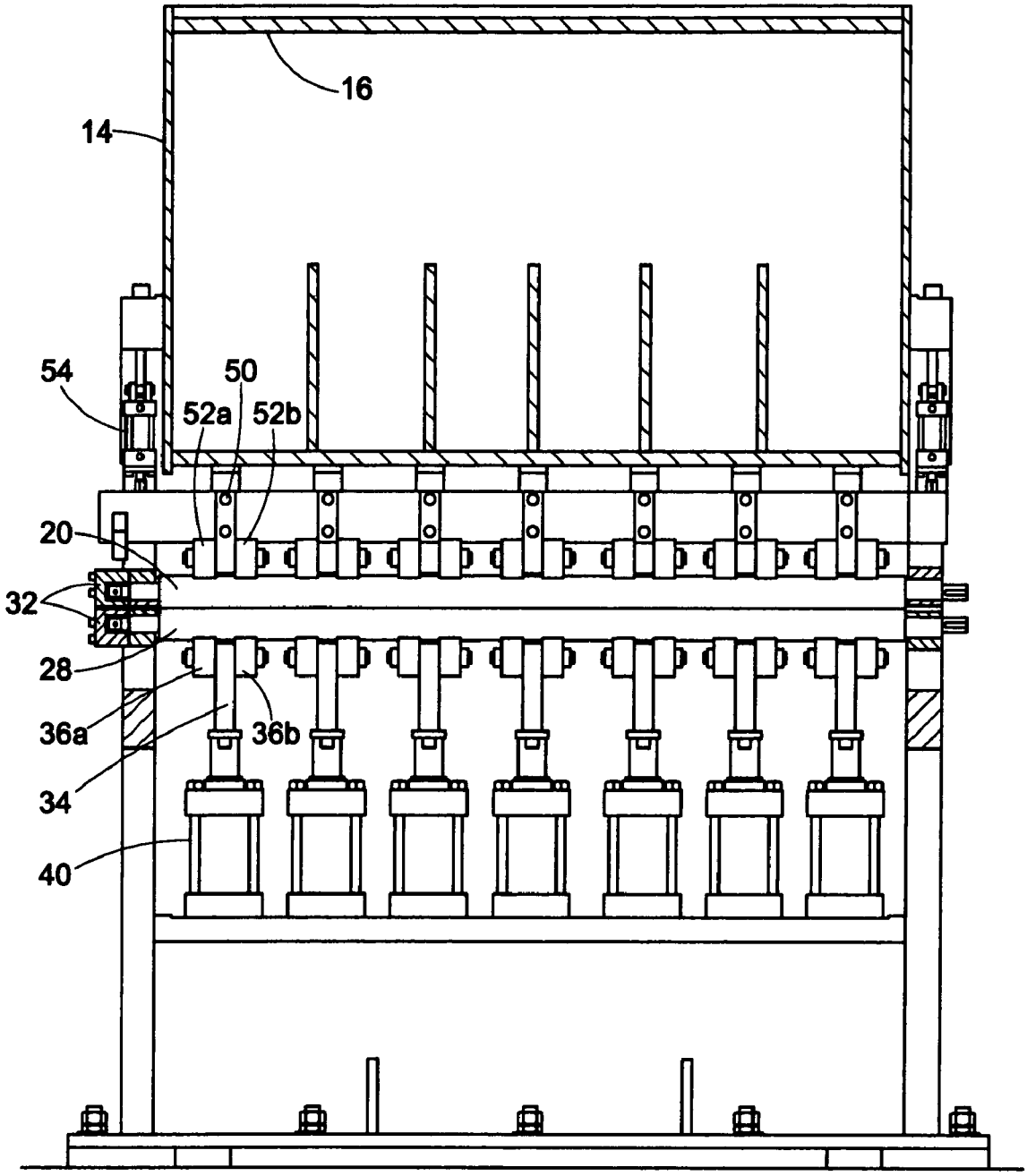
FIG. 2 is a front elevational view of the roller leveler of FIG. 1.

Referring now to the Figures in greater detail, and in particular to FIGS. 1 and 2, therein is shown a roller leveler A comprising a weldment frame having steel side slabs 10, welded to base slab 12 to form the lower half of the frame. As best shown in FIG. 2, the upper half of frame 10 comprises slabs 14 welded to slabs 16.

Referring specifically to FIG. 1, an upper bank 18 of a plurality of separately driven work rollers 20 is supported at opposite ends of the rollers by journal beams 22. In one embodiment of the invention, the upper work roll journals are retained vertically by clamps 23, 25 as shown in FIG. 1. In the across machine direction, the upper work roll journals are constrained by gibs to prevent side shifting of the work rolls in the across machine direction. In other embodiments, the upperwork roll journal beams use cylinders for the vertical clamp. Gibs, however, are still used for the across machine retention. The upper work rolls do not shift vertically or arcuately during operation. The above described clamps are utilized for "quick" roll change.

A lower bank 26 of separately driven work rollers 28 is shown with opposite ends journalled in journal beams 30. Journal beams 30 are fitted in gibs to permit vertical and/or arcuate movement. It will be observed that work rollers 20 of upper bank 18 are spaced to nest between pairs of lower work rollers 28 in lower bank 26.

Referring specifically to FIG. 2, upper work rollers 20 and lower work rollers 28 are individually driven by drive shafts 32. There are lower back-up roller mounting beams 34 evenly spaced along the span of the lower work rollers 28, each mounting beam carrying a flight of back-up rollers 36*a*, 36*b* extending from front to rear of the roller leveler. The back-up rollers are spaced so that each flight provides two back-up rolls in tangential contact with each lower work roll. The back-up rollers are not in line across the width of the support beam. They are staggered, so only two back-up rollers are in tangential contact with the work roll. Except for the outboard, back-up rolls, forward and rearward of each flight, the intermediate back-up rolls are each in shared tangential supporting contact with a pair of work rolls 28. In one embodiment, there are a total of nine lower work rolls and eighteen lower back-up rolls, and eight upper work rolls and sixteen upper back-up rolls.

A hydraulic cylinder 40 is mounted under the front end of each lower back-up roll mounting beam 34, and a second hydraulic cylinder 42 is mounted under a rearward end of each lower back-up roll mounting beam. Actuation of hydraulic cylinders 40, 42 will cause lower back-up roll mounting beam 34 to shift vertically and/or arcuately to bring back-up rolls 36*a*, 36*b* into tangential pressure contact with adjacent lower work rollers 28.

Similarly, as shown in FIG. 2, there are also flights of upper back-up roll mounting beams 50 evenly spaced along the span of upper work rollers 20. Each mounting beam 50 carries a flight of back-up rolls 52*a*, 52*b* arranged front and rear of rollers 2*b* for tangential contact therewith. The flights of back-up rolls 52*a*, 52*b* are aligned from front to rear of the roller leveler. A flight of upper back-up rolls 52*a*, 52*b* are mounted on each back-up roll mounting beam 50. The upper back-up rolls are also positioned so that each flight provides two back-up rolls in tangential contact with each upper work roller in the same manner as described with respect to lower back-up rolls 36*a*, 36*b*.

Cylinders 54, 56 along with rotary actuator 57 (FIG. 1), are used to shift the upper back-ups such that the teeth shown on the back-up beams are either nested as shown or extended vertically and shifted laterally. Thus, the same back-up rolls can be used, even though the work rolls can be replaced with larger diameter work rolls.

One of the primary functions of a roller leveler is to remove curvature from a piece of metal strip, sheet or plate. Strip is defined to mean metal which is sufficiently narrow and is rolled sufficiently thin that it can be wrapped into a coil. A sheet is defined as metal that is, for whatever reason, cut into lengths rather than stored in coiled form. Plate is metal which is too thick, as a practical matter, to be formed into a coil.

Figure 3:
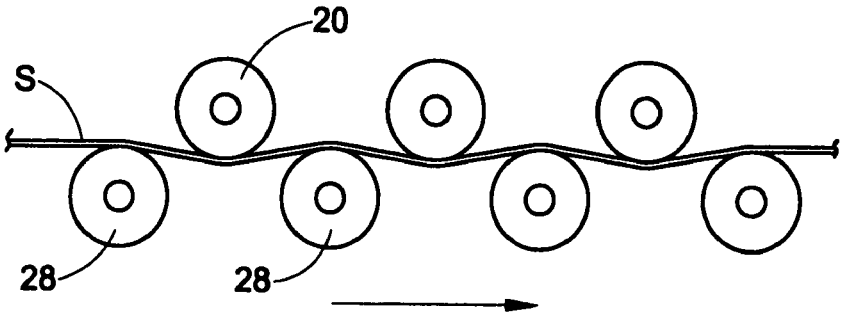
FIG. 3 is a side elevational view illustrating a metal sheet traveling between opposing work rollers.

In the case of sheets and plates, the curvature would normally be of a substantially constant radius and the roller leveler means could be of the simplest form to flatten the sheet or plate. For this operation, (see FIG. 3), the roller leveler would theoretically require an upper work roller 20 and a pair of lower work rollers 28. It will be observed that a sheet S moving from right to left is flexed downwardly between upper work roller 20 and lower work roller 28 and then is reverse flexed between upper work roller 20 and lower work roller 28 which removes the simple curvature from the sheet. To remove the curvature from the sheet the upper work roller 20 and lower work rollers 28 must be properly positioned with respect to each other. This positioning will vary depending upon the amount of curvature which must be removed from the sheet. Thus, the upper and lower work rollers are vertically adjustable with respect to each other to increase or decrease the gap between the rollers.

The other important use of roller levelers is to make corrections in the shape of strip as it comes from the rolling mill. When strip is passed between the rolls of a rolling mill, tremendous pressures are exerted against the rolls tending to force them apart. When this occurs, the strip tends to be rolled thinner at the edges than in the center portion. The difference between the thickness of the edges of the strip and of the center of the strip may be only a few thousandths of an inch or less. When this condition occurs, the edges of the strip are thinner, because more metal has been rolled in these areas than in the center portion, resulting in edges which are longer than the center portion of the strip. As a consequence, since the edges of the strip are restrained from elongating by the shorter thicker center portion of the strip, these edges respond to this restraint by forming into edge waves. Strip may also be rolled with the center portion thinner than the edge portions.

For some materials, the strip is covered with scale and other fine particulates. Additionally, as the strip passes through the leveling section, more fine scale is generated as a result of the reverse bending action. Over time, the scale or "dirt" collects on the faces of the work rolls and can ultimately imprint a mark on the strip, thus hurting the surface quality of the strip.

For some metals, the strip can have a surface scale that breaks up as the strip passes between the leveler work rolls. This scale can stick to the surfaces of the work rolls and build up to a point where the scale imprints marks on the surfaces of the strip. Additionally, other "dirt" can enter the leveler and mark the strip.

Referring now to FIGS. 4-13, various embodiments of work roll scrapers for continuously cleaning and removing the scale or "dirt" from the surface of the work rolls are shown. Various dimensions of the scrapers are provided as illustrations only and are not intended to limit the invention in any way. The cross-sectional shape of the scraper device provides its spring qualities, as well as its ability to be snapped into position between adjacent rollers, and then stay in position during operation of the leveler without falling out.

The length of the scraper device depends on the length of the work rolls, and the cross-section size and proportions are dependent on the work roll diameters and spacing. The scraper device can be manufactured from various materials, ranging from metal to plastics to carbon fiber constructions. The material choice is ultimately a function of the geometry and durability as affected by various process and environmental parameters. There may be a need to offer different materials for different applications, and the invention is not intended to be limited to a particular material.

Referring now to FIGS. 4-8, the work roll scraper in accordance with a first embodiment of the present invention is shown. The work roll scraper 100 includes a substantially "T"-shaped bar 102 formed preferably of cold rolled steel. The "T"-shaped bar increases the stiffness of the scraper and reduces noise generating vibrations. The stiff, "T"-shaped center element reduces the noise level of the scrapers. Continuous cleaning of the roll surfaces results in very smooth, dry, relatively high friction roll surfaces. This higher friction causes the scraping edges to drag on the roll surface which in turn excites the scraper at its natural frequency, which translates into noise. The T-shaped section increases the stiffness of the assembly and resists the noise generating vibrations. This is accomplished while keeping a substantially "X"-shaped member 104, which is interposed between adjacent work rolls, relatively thin and flexible. Thus, the scraper provides a flexible, lightly loaded scraping element, as well as a stiff spine formed by the "T"-shaped element to attenuate noise.

The cross-sectional shape of the scraper imparts multiple characteristics, such as spring qualities for the scraping action and self-retention and high backbone stiffness for noise attenuation. The length depends on the length of the work rolls and end mounts, and intermediate supports complete the elements needed to attenuate noise.

The substantially "X"-shaped member 104 is relatively thin and flexible and is formed preferably of full hard stainless steel. Alternately, the "X"-shaped member 104 can be formed of carbon fiber or other suitable non-metal material. The "X"-shaped member can be formed of two members 106 and 108 which have straight walls 110, 112 and two angled walls 114, 116, 118, 120 extending therefrom. The angled walls extend away from each other in opposing directions. Members 106 and 108 can be 12 inches long or another preferred length to accommodate the length of the work rolls. Members 106 and 108 are connected together via spot welding, or by mechanical joining such as screws, rivets, ets.

Figure 8:
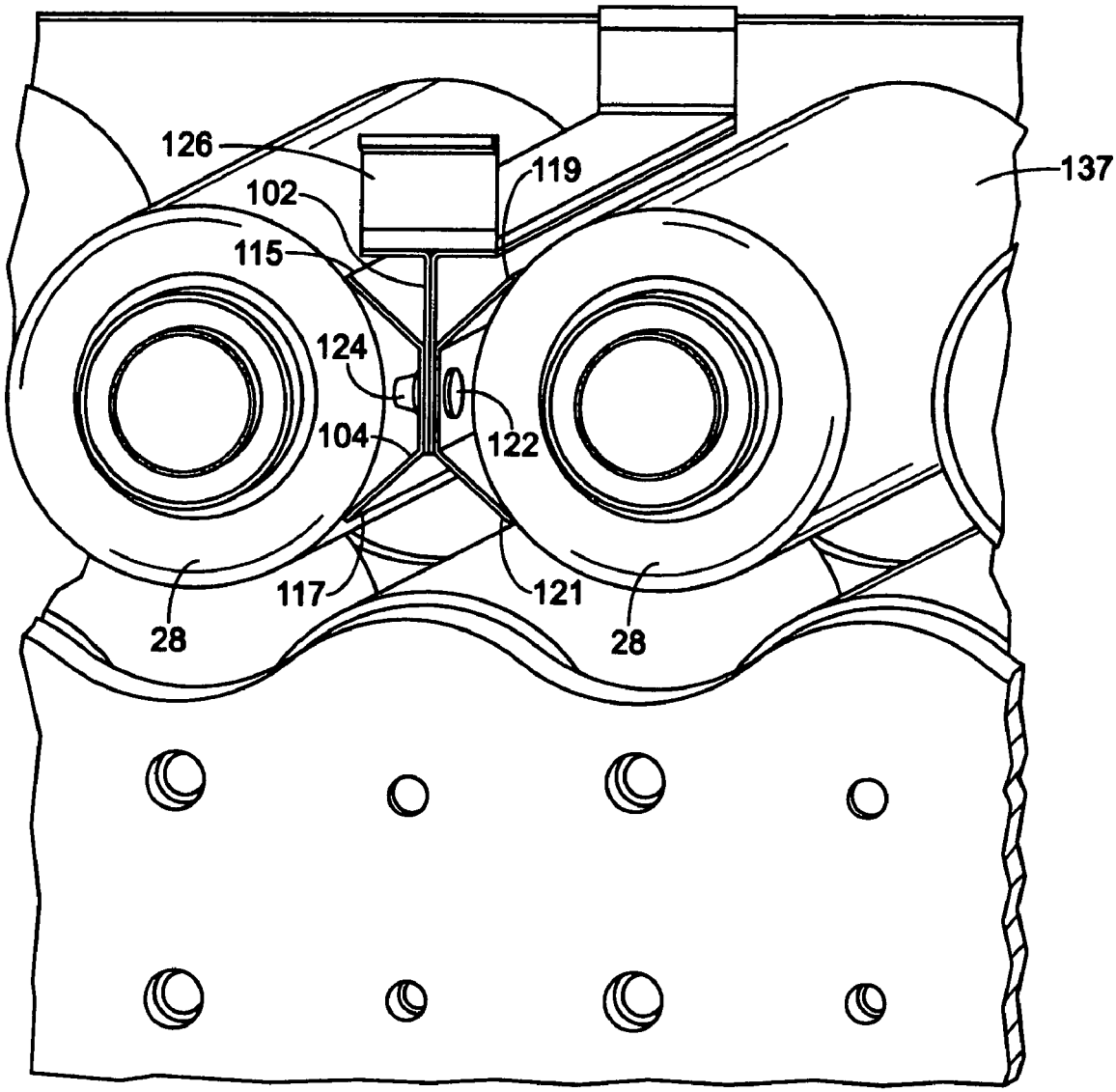
FIG. 8 is a perspective view of the work roll scraper of FIG. 4 installed between work rolls.

The scraper assembly is inserted between two adjacent work rollers, as shown in FIG. 8. The angled walls 114, 116 and 118, 120 are normally biased in an outward direction. When the scraper is inserted between the work rolls, the walls 114, 116, 118, 120 flex or "spring" inward and then become biased against the work roll's outer diameters, as seen in FIG. 8. The scraper device maintains a "spring" force against the entire length of the work roll. Each scraper device provides multiple scraping edges against a given work roll.

The scrapers are nestled between adjacent work rolls. The scrapers become self-supporting between the rolls, and the centering force overcomes forces that attempt to dislodge the scraper. These forces could occur as a result of a particle stuck to the roll surface. When the particle encounters the scraping blade and until the scraper "plucks" it off, the particle causes the scraper to move up or down relative to the work roll surface. When the particle is gone, the re-centering nature of the design restores the scraper to its natural position.

The stiff, "T"-shaped center member reduces the noise level of the scrapers. Continuous cleaning of the roll surfaces results in very smooth, dry, relatively high friction roll surfaces. This higher friction causes the scraping edges to drag on the roll surface which in turn excites the scraper at its natural frequency, which translates into noise. The T-shaped section increases the stiffness of the assembly and resists the noise generating vibrations.

Figure 5:
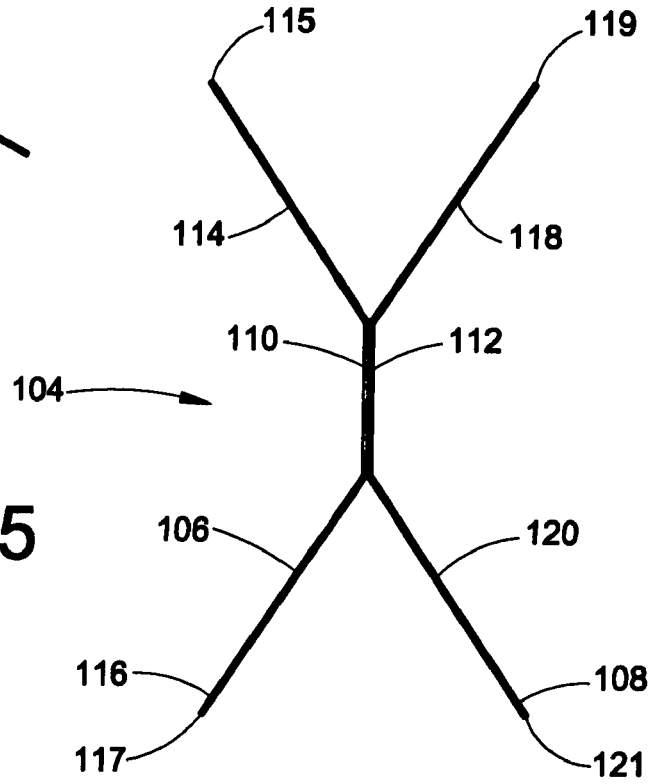
FIG. 5 is a front elevational view of an "X"-shaped member of the scraper of FIG. 4.

As shown in FIG. 5, the walls are approximately 0.005 inches thick. Walls 114, 116, 118, 120 each are formed at an angle of about 34 degrees from vertical; however, other angles, such as 45 degrees, are contemplated without departing from the scope of the invention. Edges 115, 117, 119 and 121 are formed on ends of walls 114, 116, 118 and 120 which serve as cleaning or scraping edges which contact an outer surface 137 of the work rolls. Thus, the scraper provides multiple cleaning edges for each work roller which scrapes "dirt" and scale from the work rollers as they rotate in both forward and reverse directions.

Figure 4:
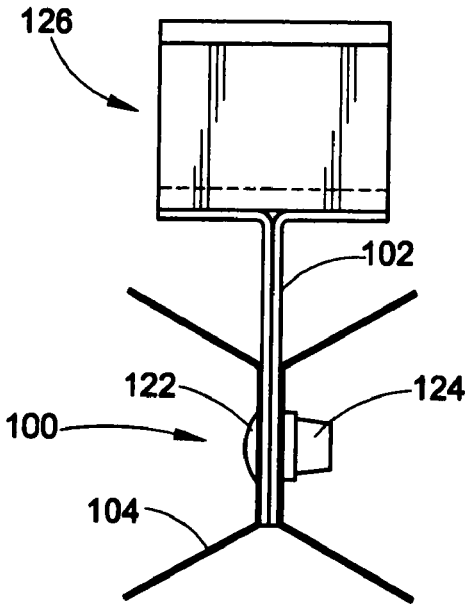
FIG. 4 is a front elevational view of a work roll scraper in accordance with a first embodiment of the invention.

The "X"-shaped member is secured to the "T"-shaped bar via a plurality of fasteners such as rivets 122 and washers 124, as seen in FIG. 4. The scraper can be selectively supported at several strategically placed locations. The scraper is fixed on its ends to the work roll journal beams. Also, in several places along its length, a spacer can be imposed between the top surface of the "T" element and an adjacent machine surface;

in this case, the back-up roll housings. These support points cooperatively prevent the scraper from vibrating beyond an acceptable amplitude from a noise generation standpoint.

Figure 6:
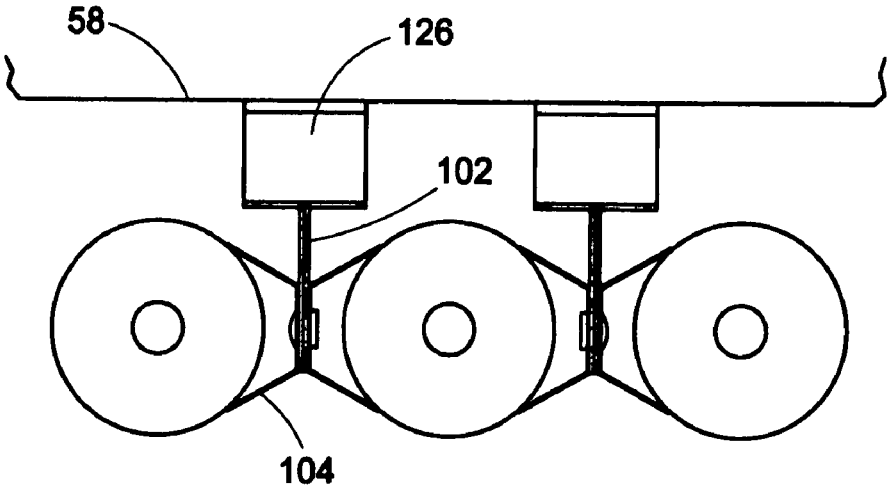
FIG. 6 is a front elevational view of the work roll scraper of FIG. 4 installed on a back-up roll housing interposed between work rolls.
Figure 7:
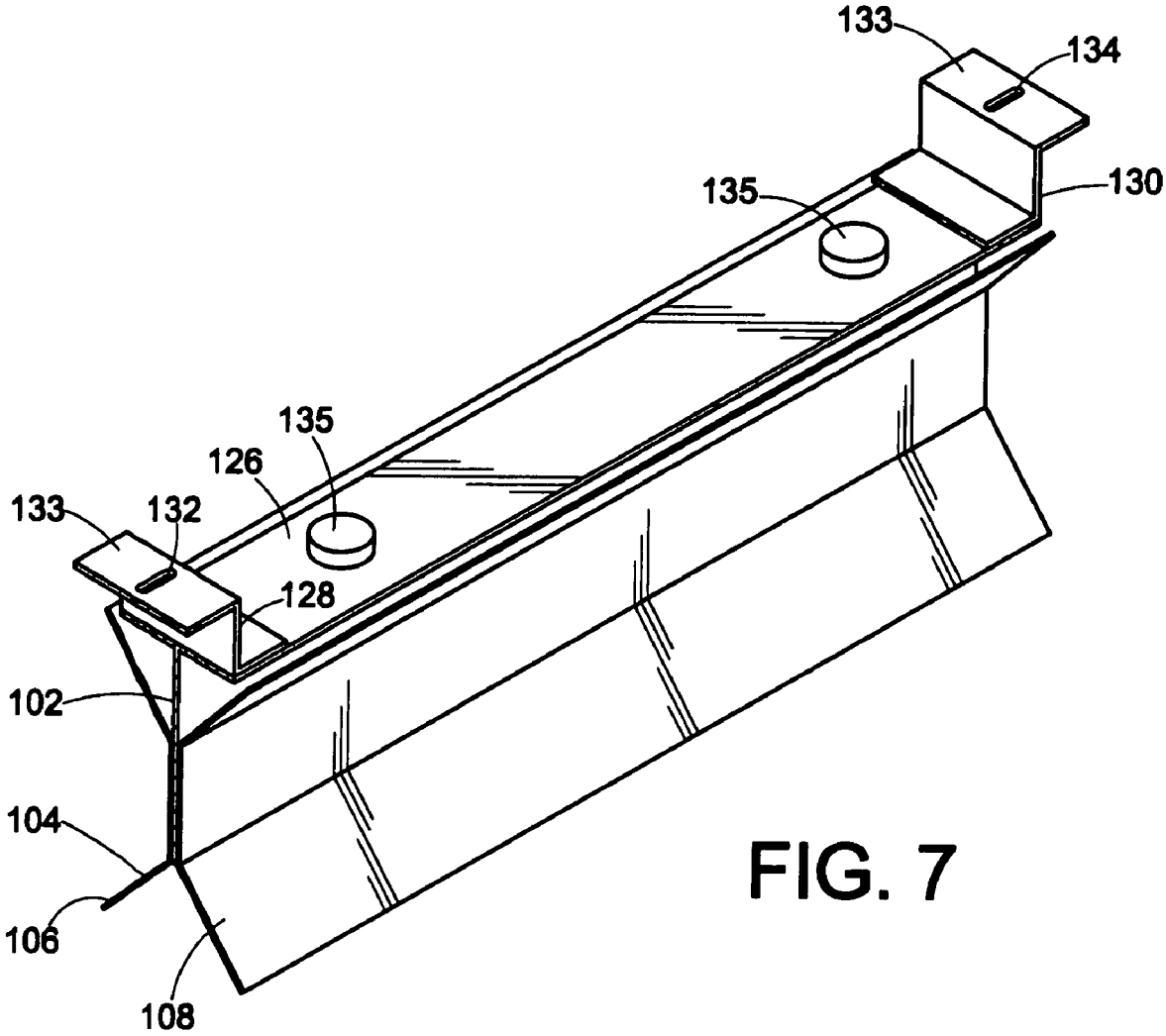
FIG. 7 is a perspective view of the work roll scraper of FIG. 4.

The "T"-shaped bar is secured to a spacer bar 126 via a plurality of plug welds between the "T"-shaped bar and the spacer bar. The spacer bar is also formed of cold rolled steel and has two "L"-shaped walls 128,130 at opposite ends for securing the bar to a work roll journal housing. An elongated slot 132, 134 is formed in an upper surface 133 of each "L"-shaped wall 128, 130. The spacer bar is mounted to the work roll journal housing 58 via the elongated slots 132, 134 as shown in FIGS. 6 and 7. Additional spacers 135 are provided along the length of the bar 126. The spacers touch the back-up roll housings and prevent vertical movement in that direction.

Figures 9, 9A, 9B:
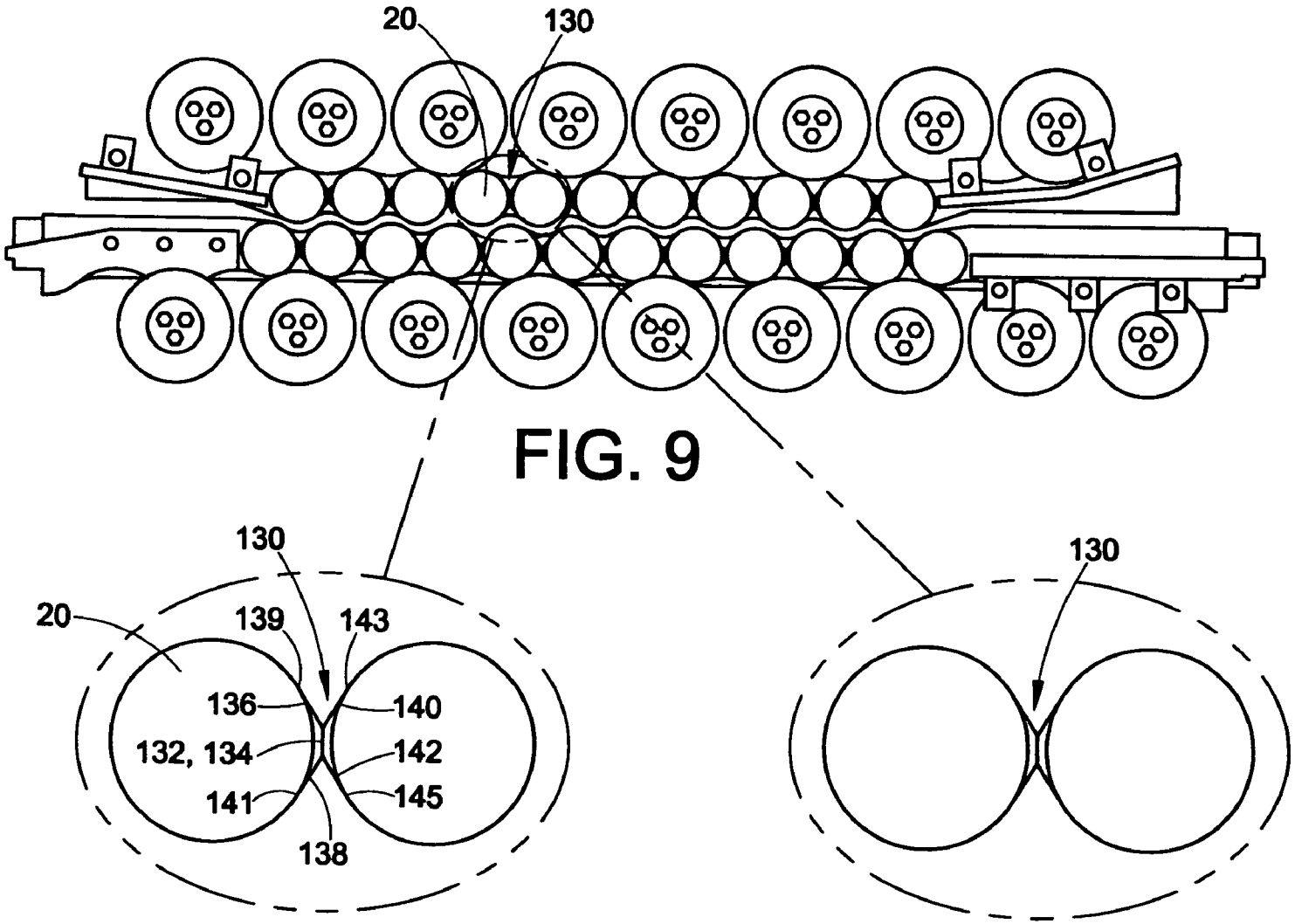
FIG. 9 is a side elevational view of a roller leveler with a work roll scraper installed according to a second embodiment of the invention.
FIG. 9A is a side elevational view illustrating the wok roll scraper of FIG. 9 in an uninstalled configuration.
FIG. 9B is a side elevational view illustrating the work roll scraper of FIG. 9 in an installed configuration.

Referring to FIGS. 9A, 9B and 9C, an alternate embodiment of the work roll scraper is shown. The scraper 130 is formed of a substantially "X"-shaped member including straight walls 132, 134 and angled walls 136, 138, 140, 142 extending therefrom. The scraper is self-retaining and is of a one-piece design. The scraper has a stiff center wall and flexible angled walls. The scraper is preferably fabricated of full hard stainless steel, or other carbon fiber or other suitable material.

Referring to FIG. 9B, the angled walls are normally biased or "sprung" in an outward direction from the center straight walls 132, 134. When the scraper is installed between adjacent work rolls (see FIG. 9C), the angled walls are flexed inwardly and then bias or press against the outer diameter surface of the work rolls. The scraper is then supported between the work rolls. The angled walls and center walls of the scraper have an elastomeric effect for stiffening and noise attenuation.

Contact edges 139, 141, 143 and 145 are formed on ends of walls 136, 138, 140 and 142 which contact outer surfaces of the work rollers for continuously cleaning the work rollers.

Figure 10:
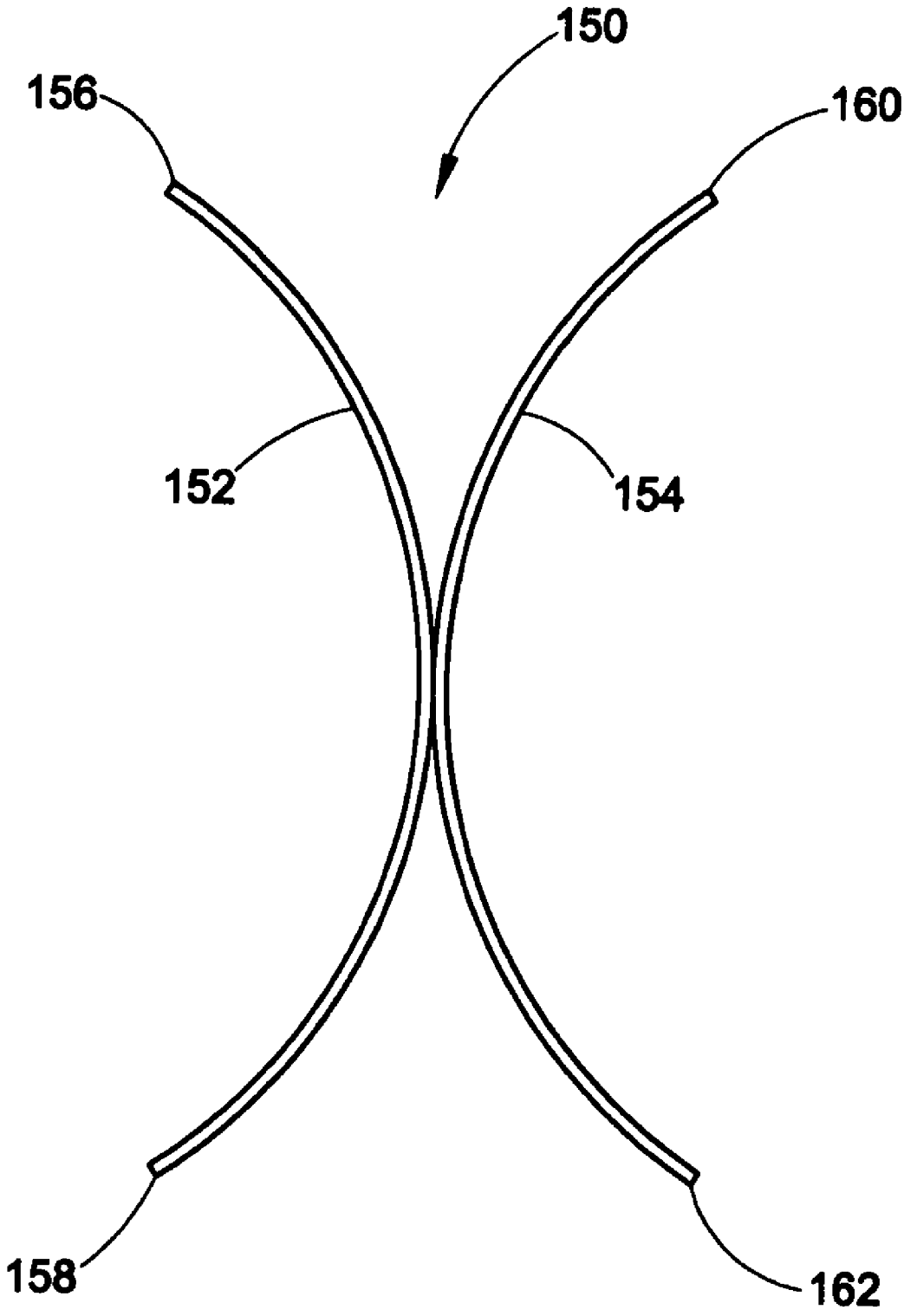
FIG. 10 is a front elevational view of a work roll scraper in accordance with another embodiment of the invention.

Referring to FIG. 10, another alternate embodiment of the scraper is shown. Scraper 150 includes two curved wall portions 152, 154 which are spot welded together. The walls curve away from each other in opposite directions. The scraper is preferably formed of resilient, flexible full hard stainless steel. The walls are shown to have a radius of ⅝-inch, and a thickness of 0.007 inches, but other dimensions can be used without departing from the scope of the invention.

The scraper is inserted between the adjacent work rollers in the same fashion as the scraper of FIGS. 9, 9A and 9B. The curved walls 152, 154 are normally in a biased position and spring "outwardly." When the scraper is inserted between the adjacent work rolls, the walls 152, 154 flex inwardly and then become biased against the outer diameter surface of the work rolls. The scraper is self-retaining and is supported by the work rollers.

Contact edges or tips 156, 158, 160, 162 abut the outer surface of the work rolls and continuously clean the work rolls during their operation. The contact edges serve to support the scraper between the work rolls. Thus, the scraper does not need to be tethered or otherwise secured to the work rolls. The resilient nature of the walls serves to self-center the scraper. That is, the flexibility of the walls allows the scraper to move slightly up or down and then readjust its position with respect to the work rolls. As the work rolls rotate, the "dirt" is scraped off or removed by the contact edges of the scraper.

Figure 11:
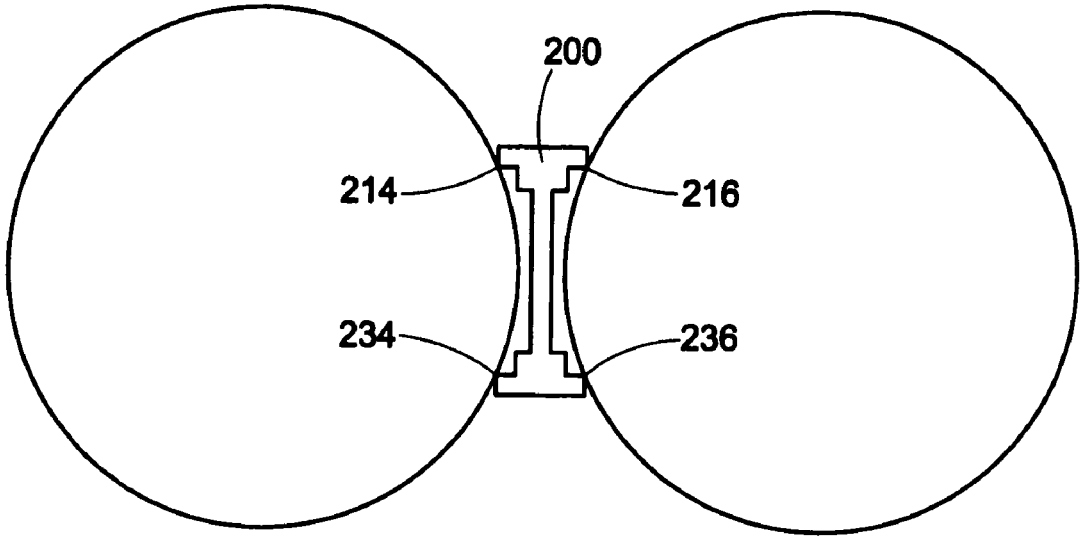
FIG. 11 is a side elevational view of a work roll scraper installed between work rolls in accordance with another aspect of the invention.
Figure 12:
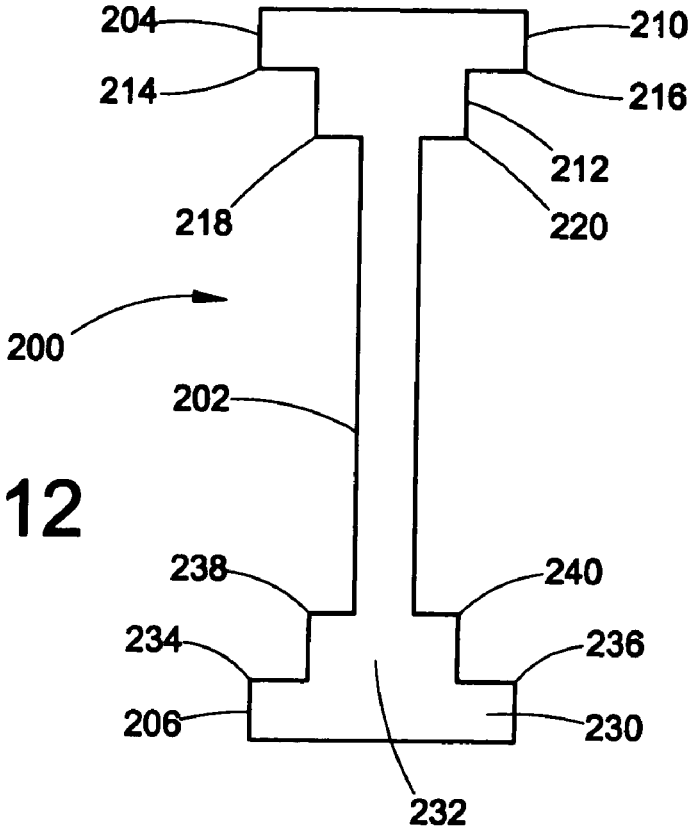
FIG. 12 is a front elevational view of the work roll scraper of FIG. 11.
Figure 13:
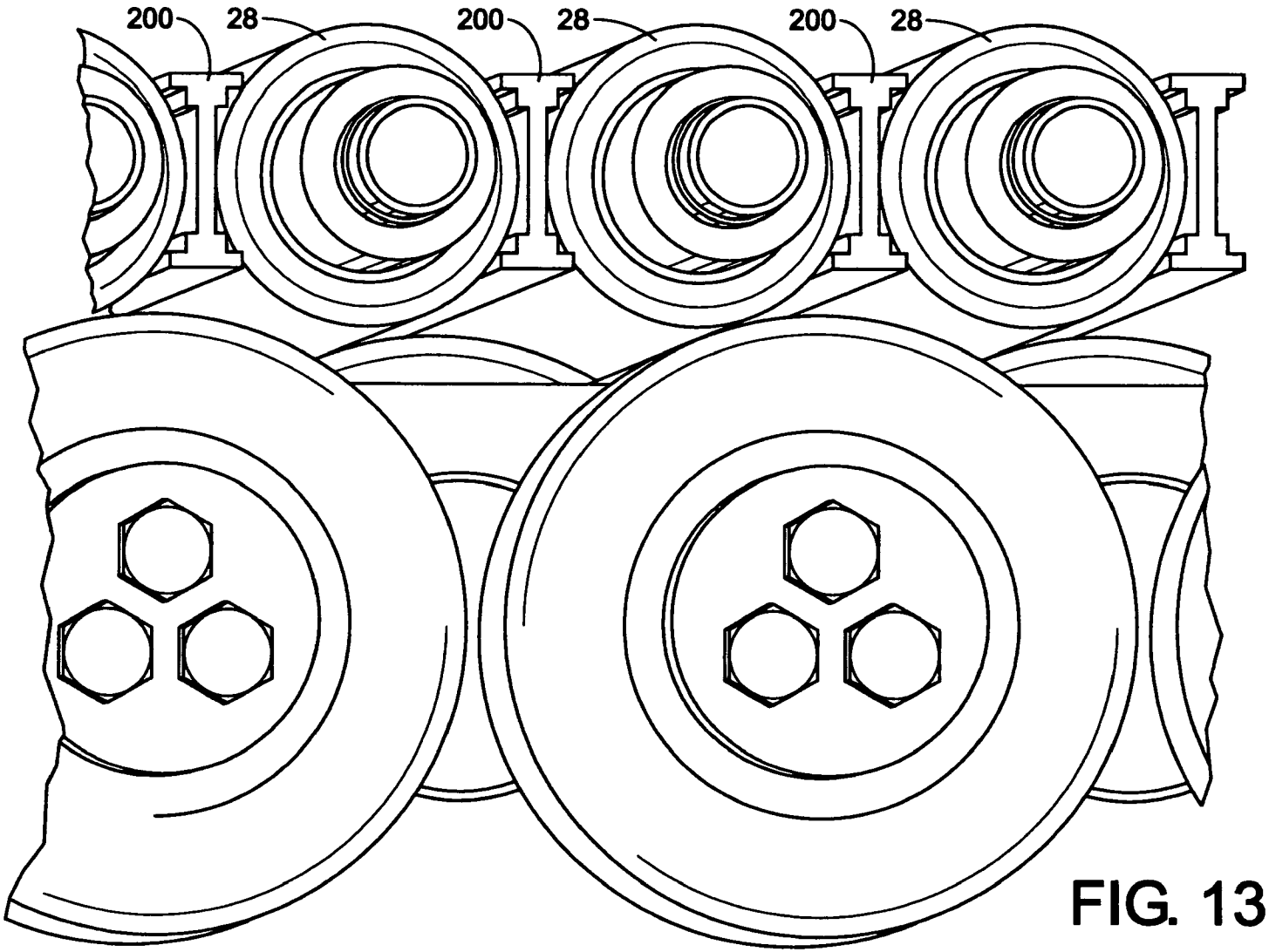
FIG. 13 is a perspective view of the work roll scraper of FIG. 11 installed between work rolls.

Referring now to FIGS. 11, 12 and 13, yet another embodiment of the work scraper is shown. The scraper 200 is formed of one piece and can be fabricated from rolled steel, although the scraper can be fabricated from other materials as well without departing from the scope of the invention.

The scraper is essentially "I"-shaped and has an elongated center bar 202, and an upper flange 204 and a lower flange 206 formed on opposite ends of the bar. Upper flange 204 has a first portion 210 and a second portion 212, where the first portion has a longer length than the second portion along a longitudinal axis of the upper flanges. Edges 214, 216 of the first portion extend beyond edges 218, 220 of the second portion.

Similarly, lower flange 206 also has a first portion 230 and a second portion 232 where the first portion has a longer length than the second portion along a longitudinal axis of the lower flanges. Edges 234, 236 of the first portion extend beyond edges 238, 240 of the second portion. Thus, the scraper 200 is symmetrical in appearance; however, symmetry is not required.

The central member 202 of the scraper serves as a stiffening portion of the scraper. The upper and lower flanges rest or abut upon the outer diameter surface of the work rolls when the scraper is installed between the work rolls.

Specifically, edges 214, 216 of the upper flange and edges 234, 236 (FIG. 12) of the lower flange abut the outer surfaces of the work rolls. The weight of the scraper essentially provides the scraping force against the outer roll surfaces.

As seen in FIG. 13, the scrapers 200 are interposed between adjacent work rolls 28. Alternatively, edges 218, 220 and 238, 240 could be positioned so that they form the contact edges with the work rolls. This scraper does not utilize a "spring" feature as does the previously described scrapers. The scraper's weight essentially holds it in place between the work rolls. The scraper's cross-section is larger than the gap between adjacent work rolls, so the scraper is self-retaining.

It is intended that the scraper device be installed between each adjacent pair of work rolls. Both top and bottom sets in the leveler, however, from a practical standpoint, make it also possible to use these devices in one or two locations in the leveler. The scraper devices stay in place between the work rolls, regardless of forward or reverse rotation of the work rolls.

Each of the above-described scraper devices provides continuous cleaning and protection against marking the strip while the leveler is working. Present technology cleans the work rolls either offline or in the leveler when no strip is being processed.

The scraper devices provide a simple installation and removal means, for those times when the device has worn or needs to be cleaned. The scraper devices support themselves between the work rolls and do not fall out. The scraper device is not tethered to other parts of the machine; however, it is contemplated that the present invention is not limited to being untethered.

It will be understood that the above-described embodiments of the invention are for the purpose of illustration only. Additional embodiments, modifications and improvements can be readily anticipated by those skilled in the art, based on a reading and study of the present disclosure. Such additional embodiments, modifications and improvements may be fairly presumed to be within the spirit, scope and purview of the invention.

The invention claimed is:

1. A roller leveler assembly comprising:

a frame;

a bank of upper and lower work rolls journalled in said frame via a work roll journal housing;

a bank of upper and lower back-up rolls in contact with said work rolls, to support said work rolls;

said work rolls perform leveling on a work product passing through a gap formed between upper and lower work rolls;

said back-up rolls mounted to said roller leveler assembly via a back-up housing;

a scraping device for continuously cleaning said work rolls, comprising:

a first wall having two angled portions and a straight portion extending between said angled portions;

a second wall having two angled portions and a straight portion extending between said angled portions;

said first wall and second wall end connected to each other via said straight portions;

wherein said angled portions of said first wall extend in an opposite direction from said angled portions of said second wall; wherein said scraping device is supported on said work rolls by said angled walls contacting said work rolls, and wherein said first wall and said second wall are formed of flexible metal to bend slightly during installation between said work rolls.

2. The roller leveler assembly of claim 1, wherein said first wall and said second wall of said scraping device together form a generally "X"-shaped conformation.

3. The roller leveler assembly of claim 1, wherein said scraping device further comprising a third wall interposed between said first wall and said second wall.

4. The roller leveler assembly of claim 3, further comprising a spacer bar connected to an upper surface of said third wall.

5. The roller leveler assembly of claim 4, wherein said scraping device is secured to said roller leveler assembly via said spacer bar.

6. A scraping device for use with work rolls of a roller leveler assembly, comprising:

a first wall having two angled portions and a straight portion extending between said angled portions;

a second wall having two angled portions and a straight portion extending between said angled portions;

said first wall and second wall end connected to each other via said straight portions;

wherein said angled portions of said first wall extend in an opposite direction from said angled portions of said second wall, and a third wall interposed between said first wall and said second wall;

wherein said first wall and said second wall are adapted to be installed between adjacent work rolls of said roller leveler; and wherein said first wall and said second wall are formed of flexible metal to bend slightly during installation between said adjacent work rolls.

7. The scraping device of claim 6, wherein said angled portions of said first wall and said second wall extend about 34 degrees from vertical.

8. The scraping device of claim 6, wherein said angled portions of said first wall and said second wall extend about 45 degrees from vertical.

9. The scraping device of claim 6, wherein said first wall and said second wall are approximately 0.005 inches thick.

10. The scraping device of claim 6, wherein said first wall and said second wall are joined together via spot welding.

11. The scraping device of claim 6, wherein said first wall and said second wall together form a generally "X"-shaped conformation.

12. The scraping device of claim 6, wherein said third wall is substantially "T"-shaped.

13. The scraping device of claim 6, wherein said first and second walls are connected to said third wall via fasteners.

14. The scraping device of claim 6, further comprising a spacer bar connected to an upper surface of said third wall.

15. The scraping device of claim 6, wherein said scraping device is secured to said roller leveler assembly via said spacer bar which is mounted to a work roll journal housing of said roller leveler.

16. The scraping device of claim 6, wherein said first wall and said second wall each has opposing edges which contact an outer surface of said work rolls to continuously clean said work rolls.

* * * * *